US007410280B2

(12) United States Patent
Erber

(10) Patent No.: US 7,410,280 B2
(45) Date of Patent: Aug. 12, 2008

(54) LIGHT GUIDE FOR LIGHTING VEHICLES, PREFERABLY MOTOR VEHICLES

(75) Inventor: Andreas Erber, Ostfildern (DE)

(73) Assignee: Odelo GmbH, Esslingen (DE)

( * ) Notice: Subject to any disclaimer, the term of this patent is extended or adjusted under 35 U.S.C. 154(b) by 148 days.

(21) Appl. No.: 10/534,269

(22) PCT Filed: Oct. 25, 2003

(86) PCT No.: PCT/DE03/03546

§ 371 (c)(1),
(2), (4) Date: Nov. 18, 2005

(87) PCT Pub. No.: WO2004/042271

PCT Pub. Date: May 21, 2004

(65) Prior Publication Data

US 2006/0104076 A1 May 18, 2006

(30) Foreign Application Priority Data

Nov. 7, 2002 (DE) ..... 102 51 849

(51) Int. Cl.
*F21V 5/00* (2006.01)
*F21V 5/02* (2006.01)
*F21V 7/04* (2006.01)

(52) U.S. Cl. ..... 362/520; 362/339; 362/626

(58) Field of Classification Search ..... 362/619, 362/620, 621, 623, 626, 328, 301, 335, 520, 362/521, 522, 339
See application file for complete search history.

(56) References Cited

U.S. PATENT DOCUMENTS

| | | | |
|---|---|---|---|
| 4,737,896 | A | 4/1988 | Mochizuki et al. |
| 6,508,576 | B2 | 1/2003 | Emmelmann et al. |

FOREIGN PATENT DOCUMENTS

| | | | |
|---|---|---|---|
| DE | 100 22 420 | A1 | 11/2001 |
| EP | 0 936 403 | A2 | 8/1999 |
| EP | 1 184 619 | A2 | 3/2002 |

*Primary Examiner*—John A Ward
(74) *Attorney, Agent, or Firm*—Laurence A. Greenberg; Werner H. STemer; Ralph E. Locher

(57) ABSTRACT

The present invention relates to a light guide for lighting vehicles, preferably motor vehicles. Light rays emitted from the light source of the light guide are reflected off of reflecting surfaces toward a light exit surface. The reflected surfaces are arranged to allow full illumination of the light exit surface.

18 Claims, 3 Drawing Sheets

LIGHT GUIDE FOR LIGHTING VEHICLES, PREFERABLY MOTOR VEHICLES

CROSS-REFERENCE TO RELATED APPLICATIONS

This application is a National Stage of International Application No. PCT/DE2003/003546 filed Oct. 25, 2003, which claims priority to German Patent Application No. DE 102 51 849.1 filed on Nov. 7, 2002. The disclosures of the above applications are incorporated herein by reference.

TECHNICAL FIELD

The invention relates to a light guide for lighting vehicles, preferably motor vehicles.

BACKGROUND

There are known light guides essentially rectangular in shape and comprising lighting means in the form of LEDs arranged in series side-by-side on one narrow end. With them, light is fed into the light guide, and reflected from reflecting surfaces towards the light exit side. A uniform illumination is thus not assured.

The object of the invention is to configure the generic light guide such that an optimum illumination of the light guide is assured with simple design conformation.

This object is accomplished according to the invention, in the light guide, of the present invention.

SUMMARY OF THE INVENTION

In the light guide according to the invention, the reflecting surfaces, viewed in the direction of the rays, are offset from each other. The reflecting surfaces are so arranged that, viewed in the direction of the rays, they adjoin each other essentially without gaps. Thus, between the individual reflecting surfaces, no shadows are cast, so that the light emitted by the lighting means is optimally utilized. As a result of the configuration according to the invention, the light exit side is fully illuminated.

Other features of the invention will appear from the additional claims, the description and the drawings.

DESCRIPTION OF THE DRAWINGS

The invention will be illustrated in more detail in terms of an embodiment represented in the drawings by way of example. In the drawings.

DETAILED DESCRIPTION OF THE PREFERRED EMBODIMENTS

Figure 1:
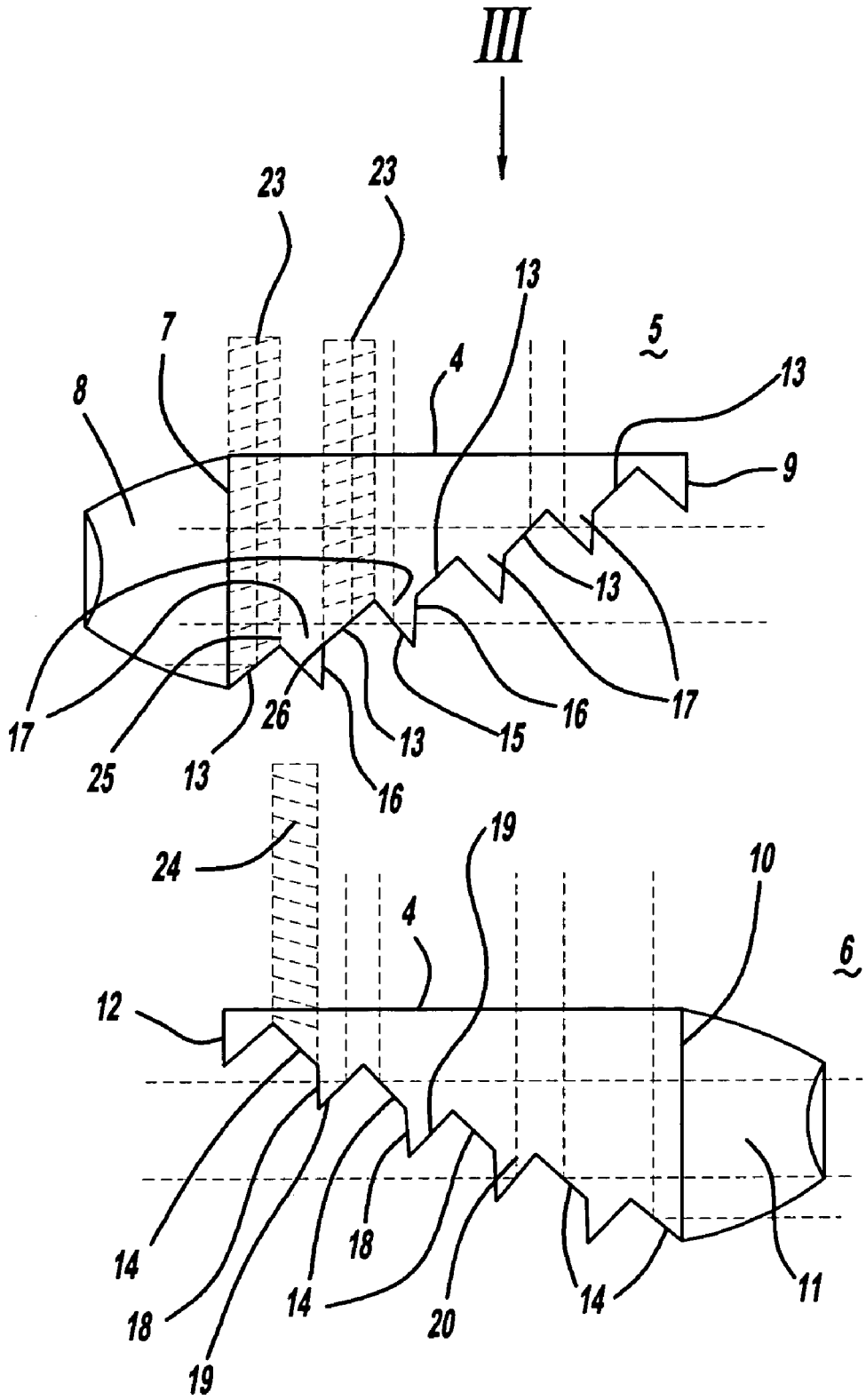
FIG. 1 shows a view of a light guide according to the invention, its light guide parts being represented separately.

The light guide 1 is intended for lighting of motor vehicles, and consists in known manner of light-conducting material. The light guide 1 has a rectangular outline in top view, with two plane side walls 2, 3 parallel to each other. On their long side, the side walls 2, 3 are connected to each other by a light exit surface 4, having a rectangular outline in top view.

The light guide 1 is made in one piece, but consists of two light guide parts 5 and 6 each having a rectangular shape in top view. The light guide parts 5, 6 are essentially of like configuration, but arranged lying rotated at 180° to each other. The two light guide parts 5, 6 have a common light exit surface 4. The light guide part 5 is provided at one end with a plane face 7, extending over the entire width and height of the light guide part 5, to which a lighting means 8, preferably an LED, is connected. From this face 7 on out, the height of the light guide part 5 decreases in the direction of the opposed face 9, which extends over the entire width of the light guide part 5.

The other light guide part 6 likewise comprises a face 10, rectangular in the view, which like the face 7 is of plane configuration, and to which an additional lighting means 11, preferably an LED, is connected. The height of the light guide part 6 diminishes from this face 10 on as far as the opposed face 12. It is of but little height, but it extends over the entire width of the light guide part 6. As may be seen in FIG. 2, the faces 7, 12 and 9, 10 each lie in a common plane. The faces 7, 10, like the faces 9, 12, lie diagonally opposed to each other.

The side of the two light guide parts 5, 6 opposed to the light exit surface 4 is provided with reflecting surfaces 13, 14, on which the light emitted from each lighting means 8, 11 is reflected to the light exit surface 4. The reflecting surfaces 13, 14 are arranged so inclined relative to the direction of the rays that the rays of light exit from the light exit surface 4 at an angle of 90°. Depending on the application, it is of course possible to arrange the reflecting surfaces 13, 14 inclined at other angles, so that the light rays will exit the light exit surface 4 at angles other than 90°.

Figure 2:
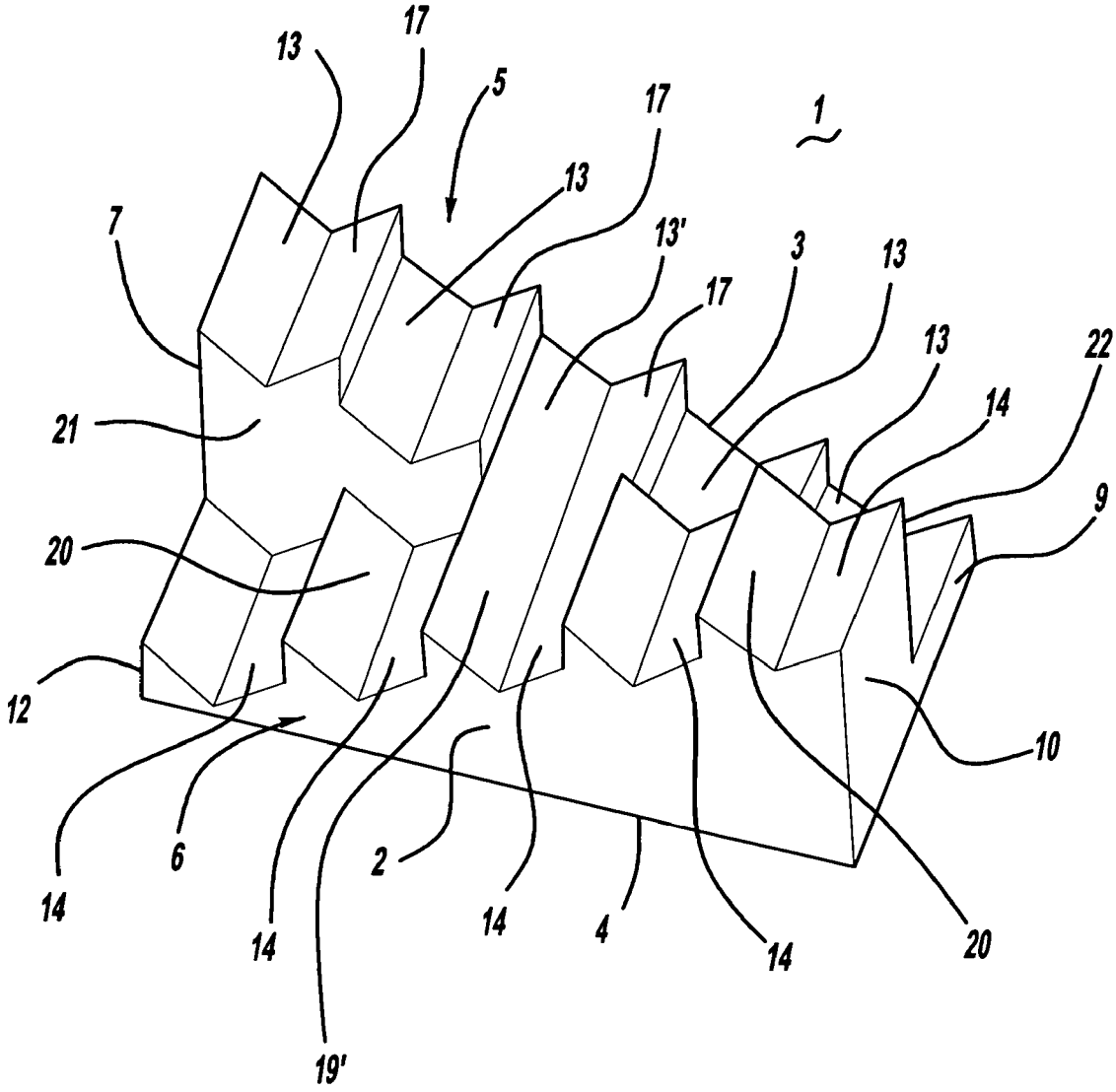
FIG. 2 shows the light guide of FIG. 1 in perspective representation.

The reflecting surfaces 13, 14 are each plane and extend, as FIG. 2 shows, over the width of the light guide part 5, 6 in question. The reflecting surfaces of the light guide part 5 are moreover inclined in opposed direction to the reflecting surfaces 14 of the light guide part 6. In this embodiment by way of example, the reflecting surfaces 14 of the light guide part 6 lie parallel to each other.

The reflecting surfaces 13 each adjoin oblique surfaces 15 inclined in opposition to them, which in turn adjoin, at acute angles, side surfaces 16 lying perpendicular to the light exit surface 4. These side surfaces 16 adjoin the respective reflecting surfaces 13 at obtuse angles. The oblique surfaces 15 and the side surfaces 16 form the side walls of projections 14, triangular in cross-section.

In like manner, the reflecting surfaces 14 of the light guide part 6 adjoin side surfaces 18 lying perpendicular to the light exit surface 4 at obtuse angles, which surfaces 18 in turn pass over into oblique surfaces 19 at acute angles. They adjoin the reflecting surfaces 14. The side surfaces 18 and the oblique surfaces 19 form side walls of triangular projections 20, triangular in cross-section.

The reflecting surfaces 13, as may be seen in FIGS. 1 and 2, lie at gap to the reflecting surfaces 14. Accordingly, the width, measured in the direction of the rays, of the reflecting surfaces 13 is equal in size to the width, measured in the same direction, of the oblique surfaces 19. Conversely, the width, measured in the direction of the rays, of the reflecting surfaces 14, is equal to the width of the oblique surfaces 15, measured in the same direction.

The reflecting surfaces 13, arranged one behind another, of the light guide part 5, from the face 7 on, have increasingly smaller distance from the light exit surface 4. The reflecting surfaces 14 of the light guide part 6, starting from the face 10 of this light guide part 6, also have increasingly smaller distance from the light exit surface 4. The reflecting surface 13' of the light guide part 5, located at half-length of the light guide 1, passes over into the oblique surface 19' of the light guide part 6, with which it lies in a common plane. From this common surface 13', 19' on, in the direction of the face 7, the light guide part 5 outreaches the light guide part 6, while conversely, from the common surface 13', 19' on, towards the face 10, the light guide part 6 outreaches the light guide part 5. The light guide part 5, 6, in its respective overreaching portion, has a plane side wall 21, 22 parallel to the side wall 2, 3 of the light guide 1.

On the basis of the stepped arrangement of the reflecting surfaces 13, 14 and their offset arrangement to each other, it is brought about that the rays emitted by the LEDs 8, 11 are reflected at the reflecting surfaces 13, 14 to the light exit surface 4. Thus, each light guide part 5, 6 generates luminous bands 23, 24 at the reflecting surfaces 13, 14, of which three luminous bands are represented in FIG. 1. The luminous bands 23, 24 of each light guide part 5, 6 lie at a distance from each other. Owing to the offset arrangement of the reflecting surfaces 13, 14 to each other, the luminous band 24, in side view as in FIG. 1, shines into the area between luminous bands 23 of the light guider part 5. This, seen in side view, generates a continuous luminous field.

The reflecting surfaces 13, 14 are each so arranged that, seen in the direction of the rays, they adjoin each other. This means that the edge 25, anterior in the direction of the rays, of the reflecting surface 13 adjoining the face 7, viewed in the direction of the rays, lies at the same level as the margin 25, posterior in the direction of the rays, of the next reflecting surface 13. In this way, the reflecting surfaces 13 of the light guide part 5 and the reflecting surfaces 14 of the light guide part 6 are arranged one behind another.

Figure 3:
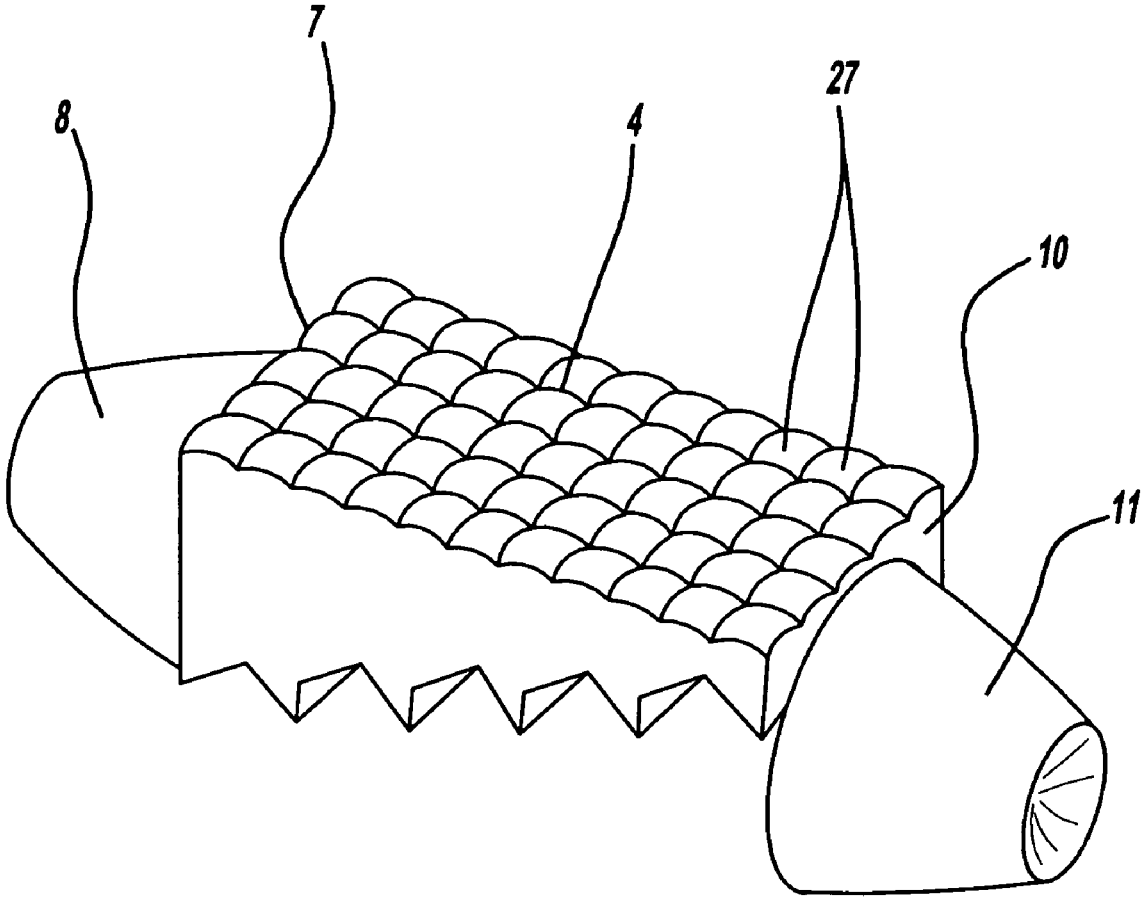
FIG. 3 shows the light guide in a view in the direction of the arrow III in FIG. 1.

Since the two lighting means 8, 11 are provided at the two ends of the light guide 1, an optimal luminous yield results, with compact structure of the light guide 1. The light is so fed into the light guide 1 that the light rays in the light guide 1 are propagated almost parallel. The stair-like reflecting surfaces 13, 14 with the projections 17, 20 located between them guide the light rays in the manner described to the light exit surface 4. The subdivision of the deflecting optics into contrary profiles makes possible a very uniform illumination of the light exit surface 4. It may be additionally provided with scattering and/or refracting elements to achieve a desired distribution of light. In the embodiment by way of example (FIG. 3), the light exit surface 4 is provided with cushion-shaped optics 27, immediately adjoining each other by way of the said area of the light exit surface 4.

The two light sources 8, 11 emit light of like color. Alternatively, it is possible for the two sources 8, 11 to emit light of different colors. Then the light exit surface 4, owing to the arrangement of the reflecting surfaces 13, 14 as described, is illuminated checkerboard-fashion by the color in question.

It is also possible, instead of the two light guide parts 5, 6, to provide additional light guide parts, in that case arranged each rotated 180° to the respective neighboring light guide parts.

The invention claimed is:

1. Light guide for lighting of a vehicle, a said light guide comprising: at least one connection side for at least one light source; a light exit side; reflecting surfaces lying transverse to the direction of the rays emitted by the light source and, viewed in the direction of the rays, adjoin each other with essentially no gaps and are offset from each other; and at least two light guide parts which, viewed in the direction of the light rays, lie side-by-side and, at their mutually opposed faces, each comprising at least one light source whose light rays are reflectable at opposedly inclined reflecting surfaces to the light exit side.

2. Light guide according to claim 1, wherein the reflecting surfaces are of equal size.

3. Light guide according to claim 1, wherein the reflecting surfaces lie parallel to each other.

4. Light guide according to claim 1 wherein the reflecting surfaces lie at 45° to the direction of the rays on light source.

5. Light guide according to claim 1, wherein neighboring reflecting surfaces lie at a distance from each other.

6. Light guide according to claim 1, wherein neighboring reflecting surfaces are separated from each other by projections of the light guide.

7. Light guide according to claim 1, wherein the reflecting surfaces of the light guide parts are arranged at gap.

8. Light guide according to claim 1, wherein the light guide parts are alike in shape.

9. Light guide according to claim 1, wherein the connection side for the light source is the face of the light guide and lies perpendicular to the direction of the rays of the light source.

10. Light guide according to claim 1, wherein the width of the reflecting surfaces of the one of said light guide parts corresponds to the distance of neighboring reflecting surfaces of the other of said light guide parts.

11. Light guide according to claim 1, wherein the two light guide parts are of equal width.

12. Light guide according to claim 1, wherein the reflecting surfaces of the two light guide parts are of equal size.

13. Light guide according to claim 1, wherein the two light guide parts are configured in one piece with each other.

14. Light guide according to claim 1, wherein the light source is at least one LED.

15. Light guide according to claim 1, wherein the light exit side is provided with scattering and/or refracting optics.

16. Light guide for lighting of a vehicle, a said light guide comprising:

at least one connection side for at least one light source;

reflecting surfaces lying transverse to the direction of the rays emitted by the light source and, viewed in the direction of the rays, adjoin each other with essentially no gaps and are offset from each other;

a light exit side; and at least two light guide parts which, viewed in the direction of the light rays, lie side-by-side and, at their mutually opposed faces, each comprising at least one light source whose light rays are reflectable at opposedly inclined reflecting surfaces of equal size to the light exit side.

17. Light guide according to claim 16, wherein the reflecting surfaces of the light guide parts are arranged at gap.

18. Light guide for lighting of a vehicle, a said light guide comprising:

at least one connection side for at least one light source;

reflecting surfaces lying transverse to the direction of the rays emitted by the light source and, viewed in the direction of the rays, adjoin each other with essentially no gaps and are offset from each other;

a light exit side; and at least two light guide parts which, viewed in the direction of the light rays, lie side-by-side and, at their mutually opposed faces, each comprising at least one light source whose light rays are reflectable at opposedly inclined reflecting surfaces to the light exit side, said at least two light guide parts configured in one piece with each other.

* * * * *